United States Patent [19]

Rayton

[11] 4,442,740

[45] Apr. 17, 1984

[54] APPARATUS AND METHOD FOR PRODUCING SLITTED PLASTIC PRODUCE WRAPPERS

[75] Inventor: Thomas R. Rayton, Calgary, Canada

[73] Assignee: 236913 Alberta Ltd., Calgary, Canada

[21] Appl. No.: 422,133

[22] Filed: Sep. 23, 1982

Related U.S. Application Data

[63] Continuation-in-part of Ser. No. 202,603, Oct. 31, 1980, abandoned.

[51] Int. Cl.[3] ..... B26F 1/18

[52] U.S. Cl. ..... 83/29; 83/30; 83/566; 83/595

[58] Field of Search ..... 83/29, 30, 509, 510, 83/566–570, 660, 678, 695; 264/156, 288.4, 291, DIG. 81, DIG. 73; 425/290, 305.1, 306

[56] References Cited

U.S. PATENT DOCUMENTS

| | | | |
|---|---|---|---|
| 2,170,646 | 8/1939 | Rosenberg | 83/658 X |
| 2,176,543 | 10/1939 | Norton | 83/566 X |
| 2,195,819 | 4/1940 | Kurtzeborn | 83/567 X |
| 2,403,035 | 7/1946 | Whitson | 83/566 X |
| 2,575,378 | 11/1951 | Bender | 83/658 X |
| 2,711,040 | 6/1955 | Kaplan | 83/30 |
| 3,318,266 | 5/1967 | Rich et al. | 425/290 X |
| 3,318,267 | 5/1967 | Artiaga et al. | 425/290 X |
| 3,520,220 | 7/1970 | Acker | 83/695 X |
| 3,587,377 | 6/1971 | Olson | 83/695 X |
| 3,826,165 | 7/1974 | Currie | 83/678 X |

FOREIGN PATENT DOCUMENTS

| | | |
|---|---|---|
| 652271 | 11/1962 | Canada . |
| 966968 | 5/1975 | Canada . |
| 971324 | 7/1975 | Canada . |

*Primary Examiner*—James M. Meister

[57] ABSTRACT

A method and device are described for producing slitted plastic film sheets of the type used for wrapping lettuce and similar produce. A form of punch press is used with an upper ram and lower platen and a tray moves in and out horizontally between the ram and platen. On the tray is a die with slitter blades over which is placed a stack of plastic film sheets. The tray moves in and the ram presses down on the sheets, cutting slits through the stack. Then the tray moves out and the stack of slitted sheets is removed. A single operator can produce 450 slitted sheets per minute with this system.

7 Claims, 4 Drawing Figures

APPARATUS AND METHOD FOR PRODUCING SLITTED PLASTIC PRODUCE WRAPPERS

BACKGROUND OF THE INVENTION

Field of the Invention

This invention relates to a novel device and method for producing slitted plastic film sheets of the type used for wrapping lettuce and similar produce and is a continuation-in-part of application Ser. No. 202,603, filed Oct. 31, 1980, now abandoned.

DESCRIPTION OF THE PRIOR ART

Slitted plastic film sheets for use in packaging articles of produce, such as fruits, vegetables, etc. have been known for many years. They are described, for instance, in Canadian Pat. No. 652,271 issued Nov. 13, 1962, and have a central portion formed with rows of spaced or interrupted slits and a solid, unslit border or margin about the slitted central portion. The slitted central portion can be stretched, widening the slits into openings to allow for circulation of air through the package wrapper.

The slits are formed by slitter blades which are mounted either in a continuous rotary system or in a form of punch press. Since the plastic film used is very thin, e.g. 1.75 mil or less, it is difficult to handle in regular sheet form and is even more difficult to handle once it has been slitted, since it loses lateral strength.

Exceedingly expensive automated continuous machines have been developed using a roller system, but apart from the very high cost of such systems, they are plagued by operational problems because of the difficult nature of the material being handled. Thus, only a single layer of thin plastic film can be fed through the machine and this means that only one wrapper can be slitted at a time. Moreover, once a single layer of thin plastic film has been slitted, it becomes exceedingly difficult to handle in a processing machine because of the lack of any lateral strength combined with the thinness and lightness of the material. A continuous machine of the above type has a capacity of about 200 slitted wrappers per minute.

Another system that has been in use has involved a simple punch press with a die having a series of slitter blades. This die was placed on the bottom of a vertically reciprocating ram and forced downwardly into sheets of plastic supported on a lower platen to form the slits. With this arrangements, the slitted plastic stayed attached to the blades of the die mounted to the ram. It was exceedingly difficult to remove the slitted sheets from the die, including the problem of operators tending to cut their fingers on the blades when reaching to grasp the slitted sheets to remove them from the die.

It is the object of the present invention to overcome the above difficulties with the punch press type of apparatus so as to increase productivity.

SUMMARY OF THE INVENTION

The present invention relates to a method for producing thin, pliable plastic produce wrappers having a central slitted area bounded by a solid, unslit margin, as well as to an apparatus specially adoped to carry out the method. The novel method comprises the steps of (a) disposing a die having a plurality of upwardly projecting blades having a thickness of about 0.01 to 0.02 inch on the surface of a support moveable horizontally between a vertically moveable upper ram and a lower platen of a punch press, the bottom face of the ram having a resilient pad, (b) laying a stack of at least 40 thin, pliable plastic sheets on said die, (c) moving said support horizontally to bring said die into vertical alignment with said ram, (d) activating said ram to press down on the plastic sheets resting on the die, thereby cutting slits through the entire stack of sheets, (e) moving said support out of vertical alignment with the ram and (f) removing the stack of slitted wrappers from the die.

This arrangement greatly simplifies operation because in the loading and unloading position the die is fully exposed and the operator can quickly and easily place a stack of plastic sheets over the die and, after the slits have been cut, the operator can again easily lift the slitted sheets from the die.

Practically any kind of punch press can be used and normally about an 8 to 10 ton press is suitable. The ram of the press is typically activated by means of a foot pedal.

The die can be of various configurations and is typically arranged with a series of short straight cutter blades in parallel rows. An important feature in the invention is the thickness of these blades. In order for the invention to be practical, at least about 40 sheets of plastic film must be slitted at one time. Initially, blades having a thickness of 0.006 inch were used but when attempts were made to slit a stack of at least 40 sheets, the blades broke. Thicker blades were then tried having a thickness of 0.025 inch and, while these went through a stack of at least 40 sheets without breaking, they had the problem of tending to fold over the edges of the slits such that the edges of slits were folded into slits of adjacent sheets. The result was that the stack of slitted sheets tended to stick together and this was commercially unacceptable. Eventually, it was determined that blades having a thickness in the range of about 0.01 to 0.02 inch could slit at least 40 sheets without the blades breaking or the edges of the slits folding. Using blades having a thickness of about 0.015 inch, a stack containing as many as 75 plastic sheets has been successfully slitted.

It has been found that very light gauge film can be used with the device of the present invention, e.g. a polyolefin film having a thickness of about 1.25 to about 1.5 inch. This compares with a minimum thickness of about 1.75 mil that can be fed through an automatic system with any kind of reliability.

Another problem that was encountered was the accumulation of static electricity on the plastic sheets which also interfered with the separation of individual slitted sheets. This problem was eventually solved by passing a continuous strip of the plastic film between a pair of de-static rolls and immediately thereafter cutting the continuous strip into individual sheets and stacking these in stacks of at least 40 sheets ready for slitting. The de-static rolls are metallic rolls having high conductivity, and are preferably made of copper although other metals may be used. Thus, according to a particularly preferred embodiment of this invention, a continuous strip of plastic film is passed between de-static rolls, cut into sheets and stacked into stacks of at least 40 sheets prior to carrying out the slitting according to this invention.

For a commercial operation, a die was produced containing 72 cutter blades in parallel rows, each having a thickness of about 0.015 inch. A polyolefin film was cut into sheets having a size of about 12×13½ inches and these were stacked into stacks of about 50 sheets.

With the tray in the loading and unloading position, a stack of 50 sheets of the film are placed on the die. The tray was then moved in to bring the die into alignment with the ram and the ram was activated, pressing down on the plastic sheets resting on the die, thereby cutting slits in the sheets. The ram returned to the up position and the tray was moved out to the unloading position where the slitted sheets were lifted from the die blades.

In order to protect the blades, the lower face of the ram includes a resilient pad into which the slitter blades are pressed after they pass through the plastic. The lower surface of this pad is formed of a resilient synthetic resin plastic material having high tear and abrasion resistance. This is quite important since otherwise particles of plastic tend to fall down into the slitted sheets because of repeated contacts with the cutter blades.

It has been found to be particularly desirable to use as the lowermost layer a very high molecular weight polyolefin, in particular, an ultrahigh molecular weight polyethylene. A typical material of this type has a molecular weight of more than 2,000,000 and is available from Chemplast Inc. of Wayne, N.J. under the designation CP-303.

Such material has the following typical properties:

| | Test Method | Typical Value |
|---|---|---|
| Density, g/cm$^3$ | D 792 | 0.94 |
| Vicat softening point °C. | D-1525B | 136 |
| Hardness - Rockwell R | D 785 | 64 |
| Tensile strength, psi | D 638 | 6,300 |
| Yield strength, psi | D 638 | 3,400 |
| Flexural modulus, psi | D 780B | 170,000 |
| Izod impact, ft.lbs/in.notch | D 256A | |
| 23° C. | | No break |
| −140° C. | | No break |
| Tensile impact, ft.lbs in.$^3$ | D 1822 | 1030 |
| Shear strength, psi | D 732 | 3,500 |
| Flexural modulus of elasticity, psi | | 110,000 |
| Compression deformation, (% thickness change 1 min after stress Removal) | | |
| 900 psi at 20° C. | | 2.8 |
| 900 psi at 50° C. | | 4.4 |
| 900 psi at 80° C. | | 5.0 |

With the method and device of the present invention a single operator can produce 450 sheets per minute and as many as 150,000 sheets per shift. This compares with a maximum of about 200 sheets per minute on existing automatic machines which are not only prone to stoppages but also have an initial cost many times that of the device of the present invention.

Certain preferred embodiments of the present invention will now be illustrated by the attached drawings in which.

Figure 1:
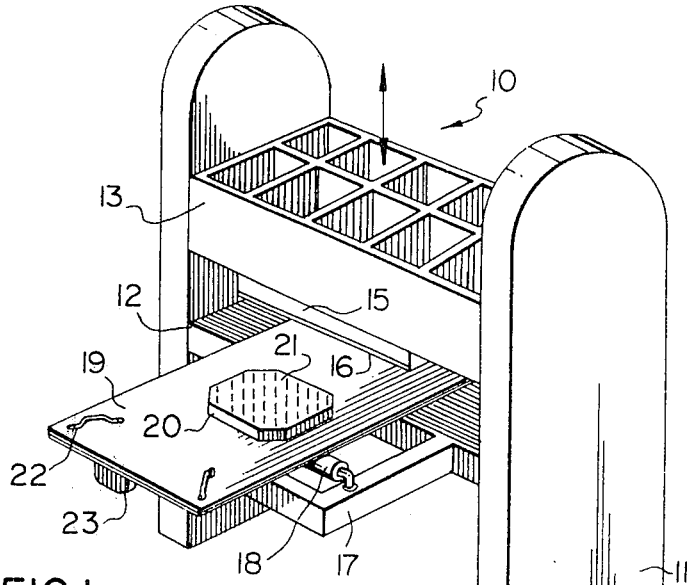
FIG. 1 is a generally schematic perspective view of the device of the invention.

As will be seen from FIG. 1, the device includes a punch press 10 having end supports 11, a heavy lower platen 12 and a vertically moveable ram 13. The ram 13 moves upwardly and downwardly by an electric motor (not shown), and is activated by footpedal 14.

Fixed to the bottom of ram 13 is a resilient elastomeric pad 15 and fixed to the lower face of this pad 15 is an ultrahigh molecular weight polyethylene layer.

Extending outwardly from one side of the punch press 10 is a frame 17 supporting rollers 18. Supported on the rollers 18 is a tray 19 adapted to move horizontally between an outer loading and unloading position and an inner cutting position. It is shown in the outer loading and unloading position in FIG. 1. The tray has a die block 20 mounted thereon with slitter blades 21 mounted in slots within the die block 20. The tray is further provided with a pair of handles 22 for moving the tray between inner and outer positions and also includes a stop 23 which engages frame 17 to determine the maximum distance which the tray can move inwardly into the press.

Figure 3:
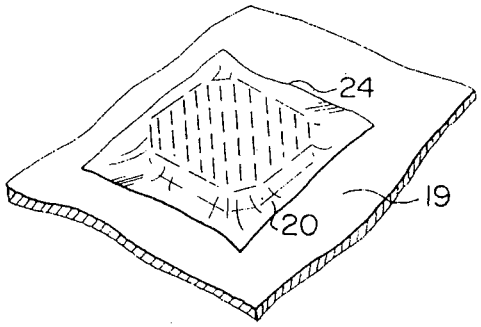
FIG. 3 is a partial perspective view of a tray and die with plastic sheets ready for slitting and FIG. 4 is a partial perspective view of a tray and die showing slitted sheets being removed from the die.
Figure 4:
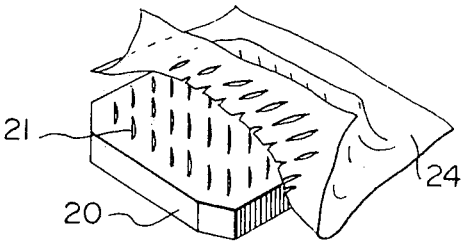

With the device of FIG. 1, the operator lifts a stack of about 50 sheets of plastic film 19 from a cutting machine and places them over the die 20, as shown in FIG. 3. The tray 19 is then pushed inwardly until the stop 23 engages the frame 17, at which point the operator steps on the footpedal 14, thereby activating the ram 13 so that the ram and the resilient pads 15, 16 move downwardly, pressing against the plastic films on the die thereby cutting slits in the plastic sheets. When the ram has completed its cycle, it returns to the position shown in FIG. 1 and the tray is then pulled back out to its loading and unloading position. The slitted sheets are lifted from the die 20 as shown in FIG. 4 and placed in a shipping carton and the cycle is then repeated.

Figure 2:
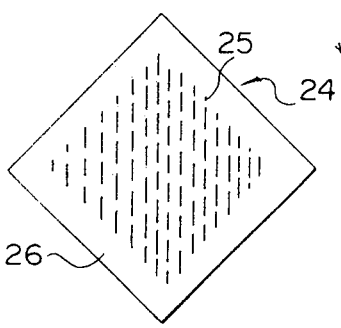
FIG. 2 is a top plan view of a slitted sheet produced according to the invention.
Figure 2:
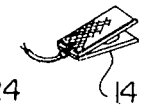

The slitted sheets are as shown in FIG. 2 where the sheet 24 contains a series of slits 25 bounded by a solid unslit margin 26.

It will be appreciated that the apparatus described above represents only one specific embodiment of the invention found to work well. Thus, many variations of the appartus are possible within the scope of the invention, including the manner of mounting the tray for horizontal movement, the means for moving the tray between the loading and unloading position and the cutting position, the configuration of the die, the configuration of the punch press, etc.

I claim:

1. A method for producing thin, pliable plastic produce wrappers having a central slit area bounded by a solid, unslit margin which comprises the steps of (a) disposing a die having a plurality of upwardly projecting blades having a thickness of about 0.01 to 0.02 inch on the surface of a support moveable horizontally between a vertically moveable upper ram and a lower platen of a punch press, the bottom face of the ram having a resilient pad, (b) laying a stack of at least 40 thin, pliable plastic sheets on said die, (c) moving said support horizontally to bring said die into vertical alignment with said ram, (d) activating said ram to press down on the plastic sheets resting on the die, thereby cutting slits through the entire stack of sheets, (e) moving said support out of vertical alignment with the ram and (f) removing the stack of slitted wrappers from the die.

2. A method according to claim 1 wherein the plastic is a polyolefin film having a thickness of 1.25 to 1.5 mil.

3. A method according to claim 2 wherein the die blades have a thickness of about 0.015 inch.

4. A method according to claim 1 wherein the stack of plastic sheets is prepared by passing a continuous strip of plastic film between a pair of de-static rolls, immediately thereafter cutting the film into sheets and forming stacks of said sheets.

5. A method according to claim 4 wherein the de-static rolls are copper rolls.

6. A device for producing thin, pliable plastic produce wrappers having a central slit area bounded by a solid, unslit margin, comprising a punch press having a vertically moveable ram with a bottom face, a lower platen beneath said ram, a die with cutter blades for cutting slits in said pliable plastic between said ram and lower platen and means for activating downward and upward motion of said ram, characterized by a horizontally moveable tray having a die with cutter blades having a thickness of about 0.01 to 0.02 inch mounted on the top face thereof, said tray being movable between an outer loading and unloading position and an inner cutting position between said ram and lower platen and further characterized by a resilient pad fixed to the bottom face of the ram, at least the lower face of said pad being formed of a resilient synthetic resin material having high tear and abrasion resistance.

7. A device according to claim 6 wherein the blades have a thickness of about 0.015 inch.

* * * * *